United States Patent [19]

Hesselschwerdt

[11] 4,432,654

[45] Feb. 21, 1984

[54] WRIST WATCH CASE AND METAL BRACELET ASSEMBLY

[75] Inventor: Bernhard Hesselschwerdt, Cranston, R.I.

[73] Assignee: Bulova Watch Company, Inc., Flushing, N.Y.

[21] Appl. No.: 362,848

[22] Filed: Mar. 29, 1982

[51] Int. Cl.[3] ..... G04B 37/00

[52] U.S. Cl. ..... 368/282; 224/164

[58] Field of Search ..... 368/276, 281–282, 368/295, 301, 303, 304; 24/265 WS; 224/164–177

[56] References Cited

U.S. PATENT DOCUMENTS

| | | | |
|---|---|---|---|
| 2,446,065 | 7/1948 | Starke | 368/282 |
| 3,975,899 | 8/1976 | Haber | 368/282 |

FOREIGN PATENT DOCUMENTS

| | | | |
|---|---|---|---|
| 280560 | 5/1952 | Switzerland | 368/282 |
| 337465 | 5/1959 | Switzerland | 368/282 |
| 380035 | 3/1964 | Switzerland | 368/282 |
| 473421 | 7/1969 | Switzerland | 368/282 |
| 570647 | 7/1975 | Switzerland | 368/282 |

*Primary Examiner*—Vit W. Miska

*Attorney, Agent, or Firm*—Michael Ebert

[57] ABSTRACT

A wrist watch case and metal bracelet assembly in which the complementary components of the bracelet are attached to the ends of the case in a manner simulating a "soldered look," yet the components may be detached to replace the bracelet. The case, which is adapted to accommodate the watch movement, has a generally rectangular shape. The ends at the rear face of the case each have a notch therein to define a broad ledge bordered by fingers. Bridging the fingers on each end is a retractable cross bar having axially-extending pins which are socketed in cavities formed in the fingers, the bar being raised slightly above the ledge. Received within each ledge is the tail of a respective bracelet component, the tail having a transverse groove therein to admit the cross bar which acts to link the component to the case. The ledge overlaps the front face of the tail so that the linked component appears to be integrated with the case.

5 Claims, 5 Drawing Figures

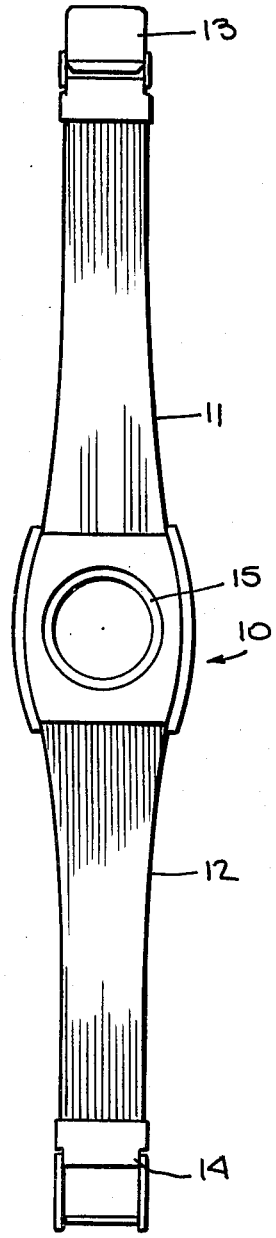
Fig. 1.
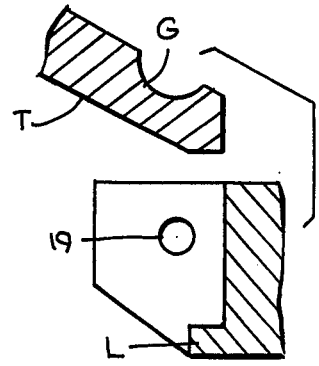
Fig. 3.
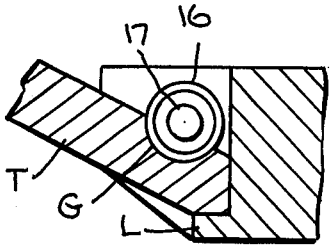
Fig. 4.
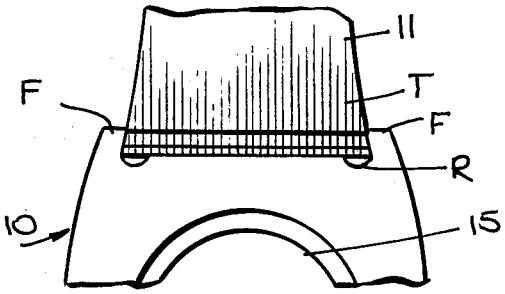
Fig. 5.
Fig. 2
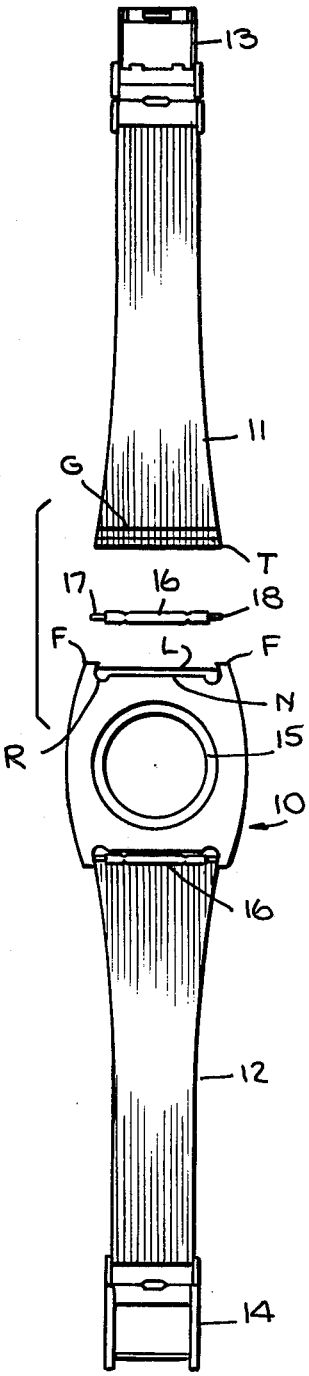

WRIST WATCH CASE AND METAL BRACELET ASSEMBLY

BACKGROUND OF THE INVENTION

This invention relates to timekeeping wrist watches, and in particular to a watch case and metal bracelet assembly in which the complementary components of the bracelet are detachably linked to the ends of the case in a manner simulating a "soldered look."

In conventional modern watches, the timekeeping movement is housed within a metal case provided with a pair of projecting lugs at either end. Each pair of lugs is bridged by a retractable cross bar having spring-biased pins or pintles extending axially therefrom to be received within small cavities formed in the lugs. The watch strap or bracelet associated with the case may be fabricated of leather, plastic, metal or other flexible material, the strap being constituted by two complementary components whose adjacent ends terminate in a buckle, a clasp or other means to join the components together at a position appropriate to the size of the wearer's wrist. The other ends or tails of the strap components are in a looped formation or are provided with a fixture having a transverse bore to admit the cross bar, thereby linking the components to the case.

The conventional case and bracelet arrangement makes it a relatively simple matter to couple or decouple the strap or bracelet components. In order, therefore, to replace a worn bracelet with a fresh bracelet of the same or a different design, one need only displace the pintles inwardly with a suitable tool to release the cross bar from the lugs, after which the bars are removed from the worn bracelet component and inserted in the loops or bores of the fresh components which are then linked to the projecting lugs of the case.

From the standpoint of aesthetics or ornamental design, a conventional linked case and bracelet assembly in which the case is provided with opposing pairs of projecting lugs is incompatible with modern design trends. Current design directions reflect the "minimilist" school of art and is toward extreme simplicity and the avoidance of detail. In order, therefore, to create a watch case and bracelet having a severe and uncluttered appearance, it is now the practice with metal bracelets to weld or solder the bracelet components to the ends of a case having no projecting lugs. This simple integration of bracelet and case has an appearance that is often referred in the trade to as the "soldered look."

The "soldered look," though it satisfies modern design trends, has distinct practical drawbacks. If the bracelet is worn or damaged and in need of replacement, or the wearer wishes to replace an existing metal bracelet with a bracelet having a different ornamental appearance, he cannot do so, for the bracelet is permanently integrated with the case. Hence, to replace a damaged bracelet one must first take the watch movement out of the case and insert it into a new integrated case and bracelet combination, even though the case may still be in good condition.

SUMMARY OF INVENTION

In view of the foregoing, the main object of this invention is to provide a watch case and metal bracelet assembly in which the complementary components of the bracelet are detachably linked to the ends of the case in the manner simulating a "soldered look."

More particularly, an object of this invention is to provide an assembly of the above type in which each component of the bracelet is linked to the end of the case by a retractable cross bar, as in a conventional case and bracelet assembly, yet to all appearances, as seen from the front face of the case, the components seem to be integrated with the case.

A salient advantage of the invention is that the bracelet may be readily replaced with fresh components of the same or a different design, the same case being retained, thereby avoiding the need to transfer the movement to a new case.

Briefly stated, these objects are accomplished in a wrist watch case and metal bracelet assembly in which the complementary components of the bracelet are attached to the ends of the case in a manner simulating a "soldered look," yet the components may be detached to replace the bracelet. The case, which is adapted to accommodate the watch movement, has a generally rectangular shape. The ends at the rear face of the case each have a notch therein to define a broad ledge bordered by fingers. Bridging the fingers on each end is a retractable cross bar having axially-extending pins which are socketed in cavities formed in the fingers, the bar being raised slightly above the ledge. Received within each ledge is the tail of a respective bracelet component, the tail having a transverse groove therein to admit the cross bar which acts to link the component to the case. The ledge overlaps the front face of the tail so that the linked component appears to be integrated with the case.

OUTLINE OF DRAWINGS

For a better understanding of the invention as well as other objects and further features thereof, reference is made to the following detailed description to be read in conjunction with the accompanying drawings, wherein:

FIG. 1 is a perspective view, as seen from the front face of a watch case and metal bracelet assembly in accordance with the invention;

FIG. 2 is a view as seen from the rear face of the same assembly, with one of the bracelet components detached;

FIG. 3 is a section taken through the notch at one end of the case and through the tail of the related bracelet component;

FIG. 4 is the same as in FIG. 3 with the tail shown linked to the end of the case; and FIG. 5 is a top view showing the linked tail.

DESCRIPTION OF INVENTION

Referring now to FIG. 1, there is shown a watch case and metal bracelet assembly in accordance with the invention which on the visible front face thereof, as worn on the wrist of a user, appears to have a "soldered look." the assembly is comprised of a case 10 having the complementary components 11 and 12 of a metal bracelet linked thereto. The fact that these components are detachable is not apparent in the front face view.

The leading ends of bracelet components 11 and 12 are provided with complementary clasp elements 13 and 14, respectively, which serve to join the components when they encircle the wrist of the wearer. These elements form no part of the present invention, for other forms of connecting elements may be used for the same purpose. Hence the structure of these elements will not be detailed herein.

As the assembly is seen from the rear face thereof, as shown in FIG. 2, case 10 which has a generally rectangular form with straight ends, is provided with a central well 15 adapted to receive the timekeeping movement of the watch.

Each case end at the rear face has a broad notch N cut therein to define a ledge L bordered on either side by small fingers F. The inner walls of fingers F are slightly inclined to form a trapezoidal notch inlet for the tail T of the associated components (11 and 12) of the bracelet. The tail of the component is tapered so that its width is greatest at the extremity and progressively diminishes. Hence the only way the tail can be inserted in notch N is not endwise by downwardly into the notch. Thus tail T rests on ledge L, as shown in FIG. 4, but the component cannot be longitudinally pulled out of the notch. This arrangement is similar to a tongue and groove joint in woodwork.

Tail T is provided at its underside with a transverse groove G dimensioned to accommodate a retractable cross bar 16 provided with spring-biased pins 17 and 18 extending axially therefrom. These pins are socketed within cavities 19 formed in the inner wall of fingers F. A small arcuate recess R is formed at the junction of each finger F and notch N to facilitate entry of a tool for retracting the pins of the cross bar.

Thus when tail T is seated on ledge L and cross bar 16 lies within groove G, the bracelet component is locked in place. It is to be noted that the outer face of tail T is angled relative to the outer face of the bracelet to provide a foot which is seated on the ledge so that the bracelet component is then at an angle to the end of the case and thereby follows the curvature of the wearer's wrist.

Thus in assembly, first tail T of each bracelet component is inserted downwardly into notch N to rest against ledge L. Then crossbar 10 is placed into groove G and its pins inserted into the finger cavities 19, thereby locking the component in place. The procedure is reversed when one wishes to detach the components from the case for purposes of replacement.

The rear face of the assembly does, of course, reveal the manner in which the bracelet components are linked to the case, but this face is concealed when the watch is worn and to all appearances as seen from the front face, the assembly presents a "soldered look."

While there has been shown and described a preferred embodiment of a wrist watch case and metal bracelet assembly in accordance with the invention, it will be appreciated that many changes and modifications may be made therein without, however, departing from the essential spirit thereof.

Thus while the generally rectangular case illustrated herein has arcuate sides, it may have other geometric forms as long as the ends thereof are provided with the required notches.

I claim:

1. A wrist watch and metal bracelet assembly comprising:

A. a metal case for accommodating a watch movement and having ends each provided at its rear face with an elongated notch to define a broad, relatively thin ledge bordered by side fingers whose inner walls each have a cavity therein;

B. a metal bracelet formed by two complementary components which when joined together at their leading ends encircle the wrist of the wearer, each component having a tail receivable in said notch to rest on the ledge which, as seen from the front face of the assembly overlaps the tail to give a soldered look to the assembly, said tail having a transverse groove in its rear face which extends between the fingers; and C. a retractable cross bar receivable within the groove and having axially extending pins which fit into the cavities of the fingers, the inner walls of the fingers being inclined and the tail having a complementary taper whereby the tail to be received in the notch must be inserted downwardly therein, the inclination of the walls of the fingers preventing longitudinal withdrawal of the tail.

2. An assembly as set forth in claim 1, wherein the leading ends of the components are provided with connecting elements.

3. An assembly as set forth in claim 1, wherein said case has a generally rectangular configuration.

4. An assembly as set forth in claim 1, wherein said tail has an outer foot which is angled relative to the outer surface of the component, which foot rests on said ledge to cause said component to assume an angle to the case, thereby following the curvature of the wearer's wrist.

5. An assembly as set forth in claim 1, wherein said case is provided with an arcuate recess at the junction of each finger and the notch to permit the entry of a tool to retract the pins of the bar.

* * * * *